US005251451A

United States Patent [19]

Xu et al.

[11] Patent Number: 5,251,451

[45] Date of Patent: Oct. 12, 1993

[54] MULTIPLE REBOILER, DOUBLE COLUMN, AIR BOOSTED, ELEVATED PRESSURE AIR SEPARATION CYCLE AND ITS INTEGRATION WITH GAS TURBINES

[75] Inventors: Jianguo Xu, Fogelsville; Rakesh Agrawal, Emmaus, both of Pa.

[73] Assignee: Air Products and Chemicals, Inc., Allentown, Pa.

[21] Appl. No.: 937,629

[22] Filed: Aug. 28, 1992

[51] Int. Cl.[5] ..... F25J 3/02

[52] U.S. Cl. ..... 62/25; 62/39; 62/41; 60/39.12

[58] Field of Search ..... 62/25, 39, 41; 60/39.12

[56] References Cited

U.S. PATENT DOCUMENTS

| | | | |
|---|---|---|---|
| 3,210,951 | 10/1965 | Gaumer | 62/29 |
| 4,224,045 | 9/1980 | Olszewski | 62/30 |
| 4,702,757 | 10/1987 | Kleinberg | 62/24 |
| 4,796,431 | 1/1989 | Erickson | 62/31 |
| 4,936,099 | 6/1990 | Woodward | 62/24 |
| 5,080,703 | 1/1992 | Rathbone | 62/38 |
| 5,081,845 | 1/1992 | Allam et al. | 62/38 |

FOREIGN PATENT DOCUMENTS 0418139 3/1991 European Pat. Off. .

*Primary Examiner*—Ronald C. Capossela

*Attorney, Agent, or Firm*—Willard Jones, II; William F. Marsh; James C. Simmons

[57] ABSTRACT

The present invention is a liquid nitrogen reflux means improvement capable of allowing the operation of conventional dual and triple reboiler air separation cycles at elevated pressures. The improvement comprises: (a) further compressing and cooling another portion of the compressed, essentially impurities free, feed air, thereby producing a further compressed second portion; (b) removing and increasing the pressure of a portion of the liquid oxygen bottoms of the second column and heat exchanging the increased pressure liquid oxygen bottoms against at least a fraction of the further compressed second portion of step (a) so that upon heat exchange the fraction of the further compressed second portion of step (a) is at least partially condensed and the increased pressure liquid oxygen bottoms portion is at least partially vaporized; (c) feeding the at least partially condensed fraction of step (b) to at least one of the two distillation columns; (d) warming the at least partially vaporized oxygen of step (b) to recover refrigeration; (e) compressing a portion of the gaseous nitrogen product and cooling it to a temperature near its condensation temperature by heat exchange against warming process streams; and (f) condensing the cooled, compressed gaseous nitrogen product portion of step (e) and feeding the condensed nitrogen portion as reflux to at least one of the distillation columns.

14 Claims, 5 Drawing Sheets

MULTIPLE REBOILER, DOUBLE COLUMN, AIR BOOSTED, ELEVATED PRESSURE AIR SEPARATION CYCLE AND ITS INTEGRATION WITH GAS TURBINES

TECHNICAL FIELD

The present invention is related to processes for the cryogenic distillation of air at elevated pressures having multiple reboiler/condensers in the lower pressure column and the integration of those processes with gas turbines.

BACKGROUND OF THE INVENTION

In certain circumstances, such as in oxygen-blown gasification-gas turbine power generation processes (e.g., coal plus oxygen derived fuel gas feeding the humidified air turbine cycle or the gas turbine-steam turbine combined cycle) or in processes for steel making by the direct reduction of iron ore (e.g., the COREX TM process) where the export gas is used for power generation, both oxygen and pressurized nitrogen products are required. This need for pressurized products makes it beneficial to run the air separation unit which produces the nitrogen and oxygen at an elevated pressure. At elevated operating pressures of the air separation unit, the sizes of heat exchangers, pipelines and the volumetric flows of the vapor fraction decrease, which together significantly reduces the capital cost of the air separation unit. This elevated operating pressure also reduces the power loss due to pressure drops in heat exchangers, pipelines and distillation columns, and brings the operating conditions inside the distillation column closer to equilibrium, so that the air separation unit is more power efficient. Since gasification-gas turbine and direct steel making processes are large oxygen consumers and large nitrogen consumers when the air separation unit is integrated into the base process, better process cycles suitable for elevated pressure operation are required. Numerous processes which are known in the art have been offered as a solution to this requirement, among these are the following.

U.S. Pat. No. 3,210,951 discloses a dual reboiler process cycle in which a fraction of the feed air is condensed to provide reboil for the low pressure column bottom. The condensed feed air is then used as impure reflux for the low pressure and/or high pressure column. The refrigeration for the top condenser of the high pressure column is provided by the vaporization of an intermediate liquid stream in the low pressure column.

U.S. Pat. No. 4,702,757 discloses a dual reboiler process in which a significant fraction of the feed air is partially condensed to provide reboil for the low pressure column bottom. The partially condensed air is then directly fed to the high pressure column. The refrigeration for the top condenser of the high pressure column is also provided by the vaporization of an intermediate liquid stream in the low pressure column.

U.S. Pat. No. 4,796,431 discloses a process with three reboilers located in the low pressure column. Also, U.S. Pat. No. 4,796,431 suggests that a fraction of the nitrogen removed from the top of the high pressure column is expanded to a medium pressure and then condensed against the vaporization of a fraction of the bottoms liquid from the lower column (crude liquid oxygen). This heat exchange will further reduce the irreversibilities in the upper column.

U.S. Pat. No. 4,936,099 also discloses a triple reboiler process. In this air separation process, the crude liquid oxygen bottoms from the bottom of the high pressure column is vaporized at a medium pressure against condensing nitrogen from the top of the high pressure column, and the resultant medium pressure oxygen-enrich air is then expanded through an expander into the low pressure column.

Unfortunately, the above cycles are only suitable for operation at low column operating pressures. As column pressure increases, the relative volatility between oxygen and nitrogen becomes smaller so more liquid nitrogen reflux is needed to achieve a reasonable recovery and substantial purity of the nitrogen product. The operating efficiency of the low pressure column of the above cycles starts to decline as the operating pressure increases beyond about 25 psia.

U.S. Pat. No. 4,224,045 discloses an integration of the conventional double column cycle air separation unit with a gas turbine. By simply taking a well known Linde double column system and increasing its pressure of operation, this patent is unable to fully exploit the opportunity presented by the product demand for both oxygen and nitrogen at high pressures.

Published European Patent Application No. 418,139 discloses the use of air as the heat transfer medium to avoid the direct heat link between the bottom end of the upper column and the top end of the lower column, which was claimed by U.S. Pat. No. 4,224,045 for its integration with a gas turbine. However, condensing and vaporizing the air not only increase the heat transfer area of the reboiler/condenser and the control cost, but also introduces extra inefficiencies due to the extra step of heat transfer, which makes its performance even worse than the Linde double column cycle.

U.S. patent application Ser. No. 07/700,021, issued as U.S. Pat. No. 5,165,245, discloses how the pressure energy contained in the pressurized nitrogen (or waste) streams can be efficiently utilized to make liquid nitrogen and/or liquid oxygen.

SUMMARY OF THE INVENTION

The present invention is an improvement to a process for the cryogenic distillation of air to separate out and produce at least one of its constituent components. In the process, the cryogenic distillation is carried out in a distillation column system having at least two distillation columns operating at different pressures. A feed air stream is compressed to a pressure in the range between 70 and 300 psia and essentially freed of impurities which freeze out at cryogenic temperatures. At least a portion of the compressed, essentially impurities-free feed air is cooled and fed to and distilled in the first of the two distillation columns thereby producing a higher pressure nitrogen overhead and a crude liquid oxygen bottoms. The crude oxygen bottoms is reduced in pressure, and fed to and distilled in the second distillation column thereby producing a lower pressure nitrogen overhead and a liquid oxygen bottoms. A fraction of the cooled, compressed, essentially impurities-free feed air portion is at least partially condensed by heat exchange against the liquid oxygen bottoms in a first reboiler/condenser located in the bottom of the second distillation column and fed to at least one of the two distillation columns. The at least partially condensed fraction is fed to at least one of the two distillation columns. The cooled, compressed, essentially impurities-free feed air portion fed to the first of two distillation columns and the fraction of the cooled, compressed, essentially impurities-free feed air portion is at least partially condensed by heat exchange against the liquid oxygen bottoms in a first reboiler/condenser located in the bottom of the second distillation column are the same stream. At least a portion of the higher pressure nitrogen overhead is condensed by heat exchange against liquid descending the second distillation column in a second reboiler/condenser located in the low pressure column between the bottom of the second distillation column and the feed point of the crude liquid oxygen bottoms. The condensed higher pressure nitrogen is fed to at least one of the two distillation columns as reflux.

The improvement to the invention to allow effective operation of the process at elevated pressures comprises: (a) further compressing and cooling another portion of the compressed, essentially impurities free, feed air, thereby producing a further compressed second portion; (b) removing and increasing the pressure of a portion of the liquid oxygen bottoms of the second column and heat exchanging the increased pressure liquid oxygen bottoms against at least a fraction of the further compressed second portion of step (a) so that upon heat exchange the fraction of the further compressed second portion of step (a) is at least partially condensed and the increased pressure liquid oxygen bottoms portion is at least partially vaporized; (c) feeding the at least partially condensed fraction of step (b) to at least one of the two distillation columns; (d) warming the at least partially vaporized oxygen of step (b) to recover refrigeration; (e) compressing a portion of the gaseous nitrogen product and cooling it to a temperature near its condensation temperature by heat exchange against warming process streams; and (f) condensing the cooled, compressed gaseous nitrogen product portion of step (e) and feeding the condensed nitrogen portion as reflux to at least one of the distillation columns.

Although most any source of refrigeration can be used for the present invention, the preferred source is further compression and expansion of a portion of the feed air. For the present invention, this is accomplished by work expanding a second fraction of the further compressed second portion of step (a) to the operating pressure of the second distillation column and feeding the expanded fraction to an intermediate location of the second distillation column. The work generated by the work expansion of the second fraction of the further compressed second portion of step (a) can be used to further compress the another portion of the compressed, essentially impurities free, feed air in step (a).

Embodiments of the applicable process include: condensing the portion of the cooled, compressed, compressed nitrogen product of step (e) in a reboiler/condenser located in the bottom section of the second distillation column; condensing the portion of the nitrogen product of step (e) in a second passage of the reboiler/condenser located in the bottom location of the second distillation column and reducing the pressure of and feeding the condensed nitrogen to the top of the first distillation column as reflux; and condensing the portion of the nitrogen product of step (e) in a reboiler/condenser located in the bottom of the first distillation column wherein the compressed nitrogen recycle portion is condensed and feeding the condensed nitrogen recycle fraction to the second distillation column as reflux.

The process with its improvement is particularly applicable to integration with a gas turbine. When integrated, the compressed feed air to the cryogenic distillation process can be a portion of an air stream which is compressed in a compressor which is mechanically linked to a gas turbine. The integrated process can further comprise compressing at least a portion of a gaseous nitrogen product; feeding the compressed, gaseous nitrogen product, at least a portion of the compressed air stream which is not the feed air and a fuel in a combustor thereby producing a combustion gas; work expanding the combustion gas in the gas turbine; and using at least a portion of the work generated to drive the compressor mechanically linked to the gas turbine.

DETAILED DESCRIPTION OF THE INVENTION

Figure 1:
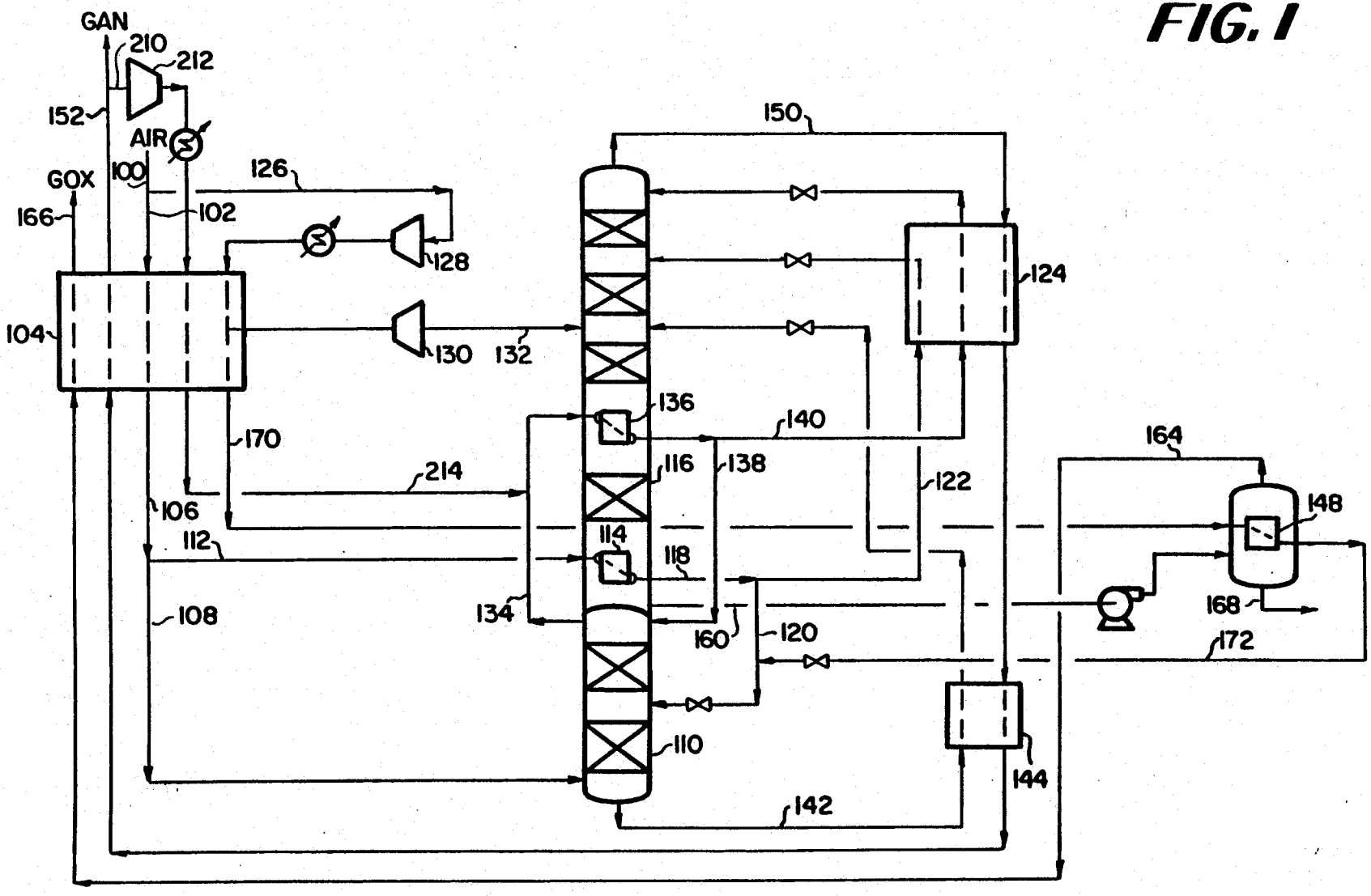
FIGS. 1-5 are flow diagrams of the process of the present invention having two reboiler/condensers in the lower pressure column.

Multiple reboiler, multiple column cycles are typically more power efficient for low purity oxygen (80-99% purity) production. However, in order for the conventional, multi-column, dual and triple reboiler air separation process cycles to operate at elevated pressures yet have an adequate oxygen recovery and nitrogen product purity, a means of providing an effective quantity of liquid nitrogen reflux must be found. The present invention is the liquid nitrogen reflux means improvement capable of allowing the operation of conventional dual and triple reboiler air separation cycles at elevated pressures. The improvement comprises: (a) further compressing and cooling another portion of the compressed, essentially impurities free, feed air, thereby producing a further compressed second portion; (b) removing and increasing the pressure of a portion of the liquid oxygen bottoms of the second column and heat exchanging the increased pressure liquid oxygen bottoms against at least a fraction of the further compressed second portion of step (a) so that upon heat exchange the fraction of the further compressed second portion of step (a) is at least partially condensed and the increased pressure liquid oxygen bottoms portion is at least partially vaporized; (c) feeding the at least partially condensed fraction of step (b) to at least one of the two distillation columns; (d) warming the at least partially vaporized oxygen of step (b) to recover refrigeration; (e) compressing a portion of the gaseous nitrogen product and cooling it to a temperature near its condensation temperature by heat exchange against warming process streams; and (f) condensing the cooled, compressed gaseous nitrogen product portion of step (e) and feeding the condensed nitrogen portion as reflux to at least one of the distillation columns.

The present invention is applicable to most conventional, multi-column, dual reboiler air separation process cycles. The present invention is particularly applicable to dual reboiler processes having at least two distillation columns which are in thermal communication with each other and operating at different pressures and having a reboiler/condenser located at the bottom of the lower pressure column, wherein at least a portion of the feed air is condensed in heat exchange against boiling liquid oxygen, and another reboiler/condenser located at an intermediate location of the lower pressure column between the bottom reboiler/condenser and the feed to the lower pressure column, wherein at least a portion of the nitrogen vapor from the higher pressure column is condensed in heat exchange against boiling liquid which is descending the lower pressure column.

FIGS. 1 through 3 and 5 illustrate the applicability of the improvement to dual reboiler/condenser process embodiments, wherein in the improvement the nitrogen vapor is removed from either the higher or lower pressure column and the pressure of the liquid oxygen is increased prior to heat exchange.

The present invention is also applicable to most multi-column, triple reboiler process cycles. The present invention is particularly applicable to triple reboiler processes having at least two distillation columns which are in thermal communication with each other and operating at different pressures and having a reboiler/condenser located at the bottom of the lower pressure column, wherein at least a portion of the feed air is condensed in heat exchange against boiling liquid oxygen, and another reboiler/condenser located at an intermediate location of the lower pressure column between the bottom reboiler/condenser and the third reboiler/condenser, wherein at least a portion of the nitrogen vapor from the higher pressure column is condensed in heat exchange against boiling liquid which is descending the lower pressure column.

To better understand the present invention, the embodiments corresponding the above listed Figures will be described in detail.

With reference to FIG. 1, compressed, clean feed air is introduced to the process via line 100 and is split into two fractions, via lines 102 and 126, respectively.

The major fraction of feed air, in line 102, is cooled in main heat exchanger 104. This cooled air, now in line 106, is then further split into two portions, via lines 108 and 112, respectively. The first portion is fed via line 108 to the bottom of higher pressure column 110 for rectification. The second portion, in line 112, is condensed in reboiler/condenser 114 located in the bottom of lower pressure column 116. This condensed second portion, now in line 118, is split into two substreams via lines 120 and 122. The first substream, in line 120, is fed to an intermediate location of higher pressure column 110 as impure reflux. The second substream, in line 122, is subcooled in heat exchanger 124, reduced in pressure and fed to lower pressure column 116 at a location above the feed of the crude liquid oxygen from the bottom of higher pressure column 110 as impure reflux.

The minor fraction of the feed air, in line 126, is compressed in booster compressor 128, aftercooled, further cooled in main heat exchanger 104, work expanded in expander 130 and fed via line 132 to lower pressure column 116. As an option, all or part of the work produced by expander 130 can be used to drive booster compressor 128.

The feed air fed to higher pressure column 110 is rectified into a nitrogen overhead stream, in line 134, and a crude liquid oxygen bottoms, in line 142. The crude liquid oxygen bottoms, in line 142, is subcooled in heat exchanger 144, reduced in pressure and fed to an intermediate location of lower pressure column 116 for distillation. The nitrogen overhead, in line 134, is removed from higher pressure column 110 and condensed in reboiler/condenser 136 against vaporizing liquid descending lower pressure column 116. Reboiler/condenser 136 is located in lower pressure column 116 at a location between reboiler/condenser 114 and the feed of crude liquid oxygen from the bottom of higher pressure column 110, line 142. The condensed nitrogen from reboiler/condenser 136 is split into two substreams via line 138 and 140, respectively. The first substream, in line 138, is fed to the top of higher pressure column 110 as reflux. The second portion, in line 140, is subcooled in heat exchanger 124, reduced in pressure and fed to the top of lower pressure column 116 as reflux.

The crude liquid oxygen from the bottom of higher pressure column 110, in line 142, and the expanded second fraction of feed air, in line 132, which is introduced into lower pressure column 116 is distilled into a low pressure nitrogen overhead and a liquid oxygen bottoms. The low pressure nitrogen overhead is removed via line 150, is warmed to recover refrigeration in heat exchangers 124, 144 and 104 and removed as a low pressure nitrogen product via line 152. A portion of the liquid oxygen bottoms is vaporized in reboiler/condenser 114 thus providing boil-up for lower pressure column 116. Another portion is removed from lower pressure column 116 via line 160, increased in pressure and fed to the sump surrounding boiler/condenser 148 wherein it is at least partially vaporized in heat exchange against a fraction of the further compressed and cooled minor portion, in line 170, thereby condensing the further compressed, feed air, minor portion. The vaporized oxygen is removed via line 164, warmed in heat exchanger 104 to recover refrigeration and removed as gaseous oxygen product via line 166. A part of the increased pressure liquid oxygen portion is removed from the process as liquid oxygen via line 168. The condensed, further compressed, feed air, minor portion is reduced in pressure and fed to the first distillation column via line 172. Finally, a portion of the nitrogen product (line 152) can be removed and recycled via line 210, boosted in pressure in compressor 212 and combined via line 214 with the nitrogen overhead (line 134) from higher pressure distillation column 110.

Figure 2:
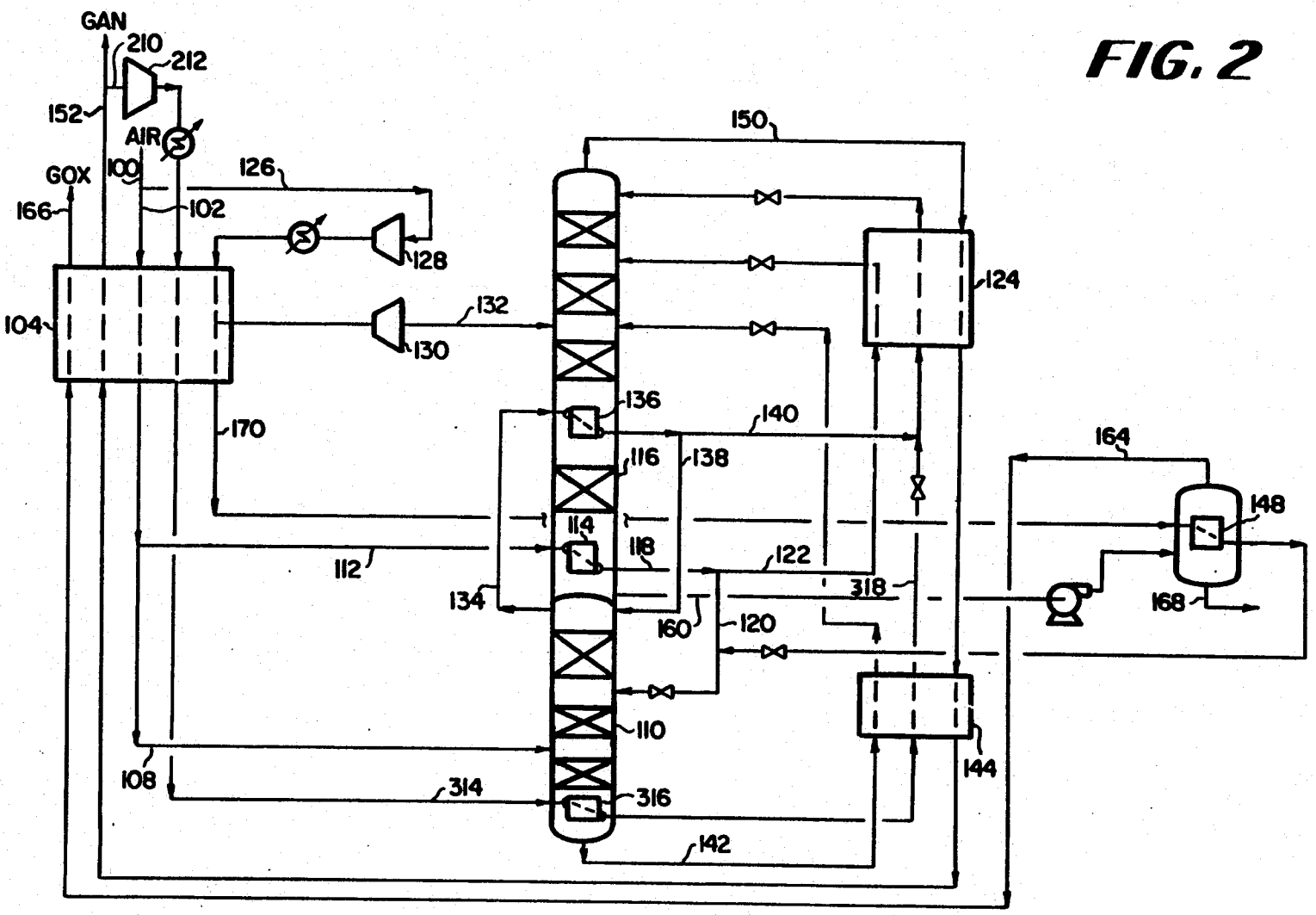

The process embodiment shown in FIG. 2 is similar to the process embodiment shown in FIG. 1. Throughout this disclosure, all functionally identical or equivalent equipment and streams are identified by the same number. The difference between FIGS. 1 and 2 embodiments is that, in FIG. 2, higher pressure column 110 is a distillation column not merely a rectification column and the major portion of the feed air in line 108 is fed to an intermediate location of higher pressure column 110. Further, the compressed, cooled, recycle nitrogen portion is not combined with nitrogen overhead from higher pressure column 110 but fed via line 314 to and condensed in reboiler/condenser 316 located in the bottom of higher pressure column 110 against boiling crude liquid oxygen. Finally, the condensed recycle nitrogen is then subcooled in heat exchanger 144, reduced in pressure and combined with condensed nitrogen in line 140.

Figure 3:
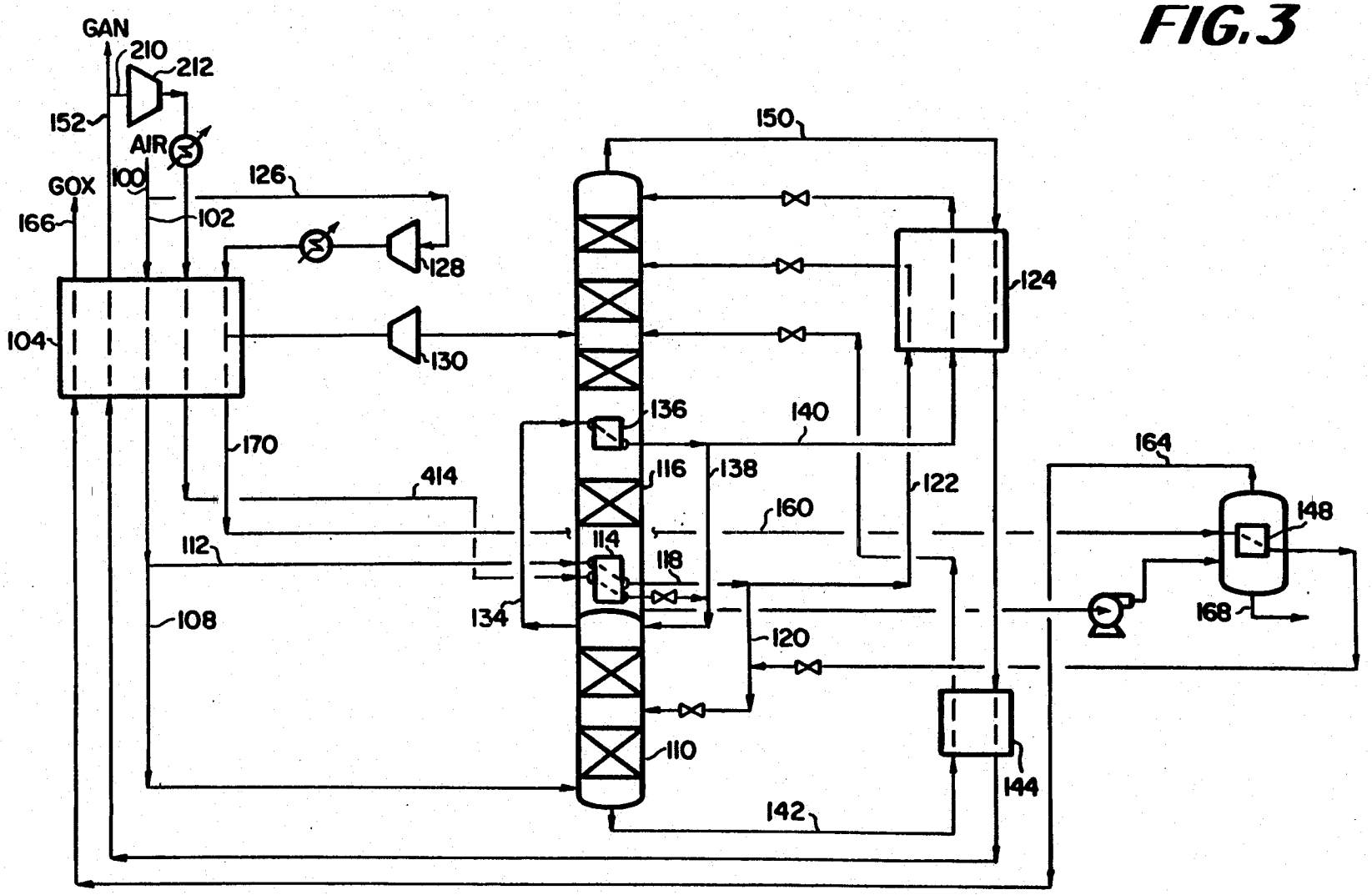

The process embodiment in FIG. 3 is based on the process embodiment of FIG. 1. The primary differences is that the compressed, cooled, recycle nitrogen portion is not combined with nitrogen overhead from higher pressure column 110 but fed via line 414 to and condensed in a second passage of reboiler/condenser 114 located in the bottom of lower pressure column 116 against boiling liquid oxygen. The condensed recycle nitrogen is then reduced in pressure and combined with condensed nitrogen in line 138.

Figure 4:
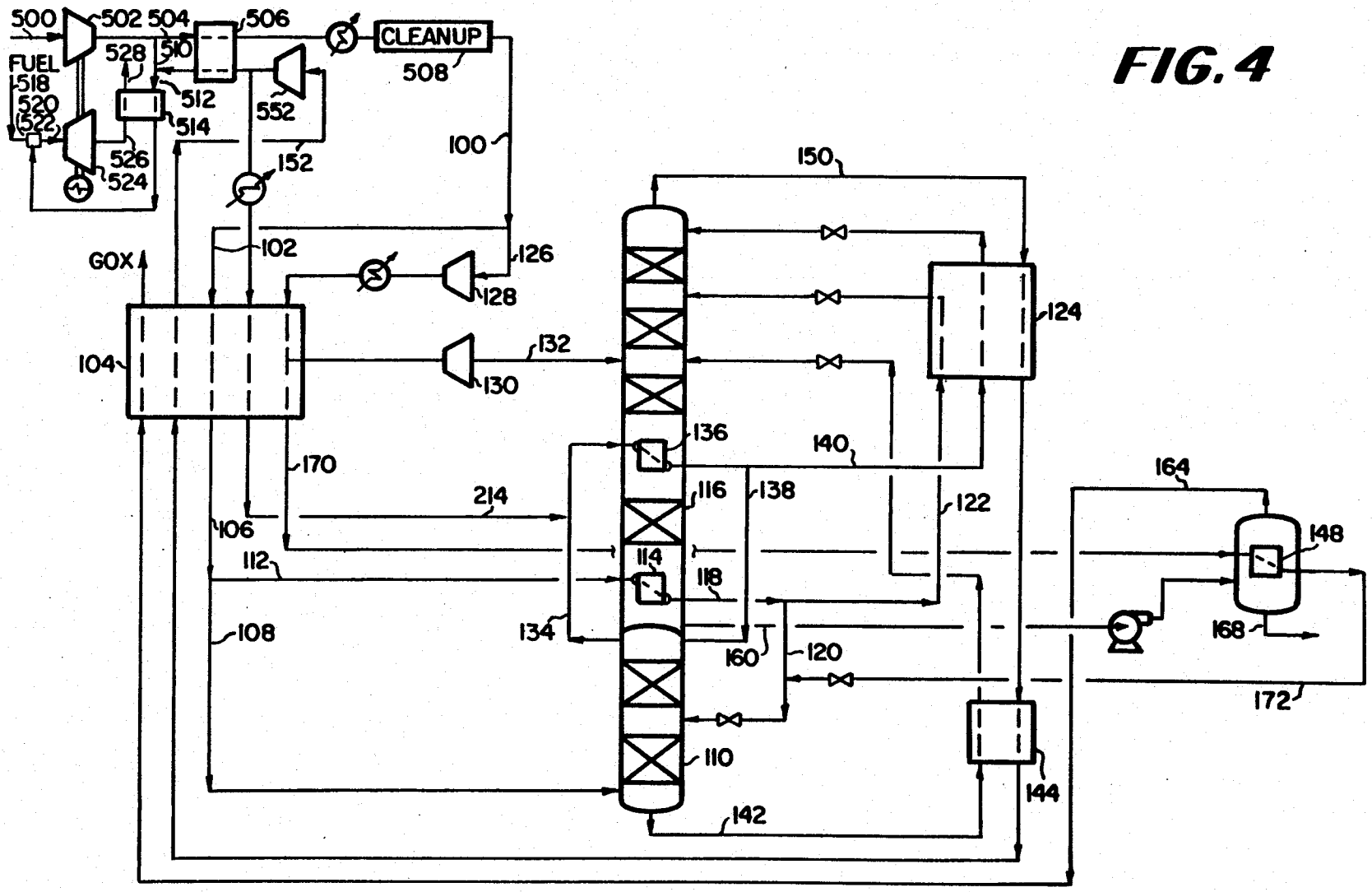

FIG. 4 depicts the process embodiment depicted in FIG. 1 integrated with a gas turbine. Since the air separation process embodiment for FIG. 1 has been described above, only the integration will be discussed here. FIG. 4 represents the so-called "fully integrated" option in which all of the feed air to the air separation process is supplied by the compressor mechanically linked to the gas turbine and all of the air separation process gaseous nitrogen product is fed to the gas turbine combustor. Alternatively, "partial integration" options could be used. In these "partial integration" options, part or none of the air separation feed air would come from the compressor mechanically linked to the gas turbine and part or none of the gaseous nitrogen product would be fed to the gas turbine combustor (i.e., where there is a superior alternative for the pressurized nitrogen product) The "fully integrated" embodiment depicted in FIG. 4 is only one example.

With reference to FIG. 4, feed air is fed to the process via line 500, compressed in compressor 502 and split into air separation unit and combustion air portions, in line 504 and 510, respectively. The air separation unit portion is cooled in heat exchanger 506, cleaned of impurities which would freeze out at cryogenic temperatures in mole sieve unit 508 and fed to the air separation unit via line 100. The gaseous nitrogen product from the air separation unit, in line 152, is compressed in compressor 552, warmed in heat exchanger 506 and, except for the recycle portion in line 214, combined with the combustion air portion, in line 510. The combined combustion feed air stream, in line 512, is warmed in heat exchanger 514 and mixed with the fuel, in line 518. It should be noted that the nitrogen can be introduced at a number of alternative locations, for example, mixed directly with the fuel gas or fed directly to the combustor. The fuel/combustion feed air stream is combusted in cumbustor 520 with the combustion gas product being fed to, via line 522, and work expanded in expander 524. FIG. 4 depicts a portion of the work produced in expander 524 as being used to compress the feed air in compressor 502. Nevertheless, all or the remaining work generated can be used for other purposes such as generating electricity. The expander exhaust gas, in line 526, is cooled in heat exchanger 514 and removed via line 528. The cooled, exhaust gas, in line 528, is then used for other purposes, such as generating steam in a combined cycle. It should be mentioned here that both nitrogen and air (as well as fuel gas) can be loaded with water to recover low level heat before being injected into the combustor. Such cycles will not be discussed in detail here.

Figure 5:
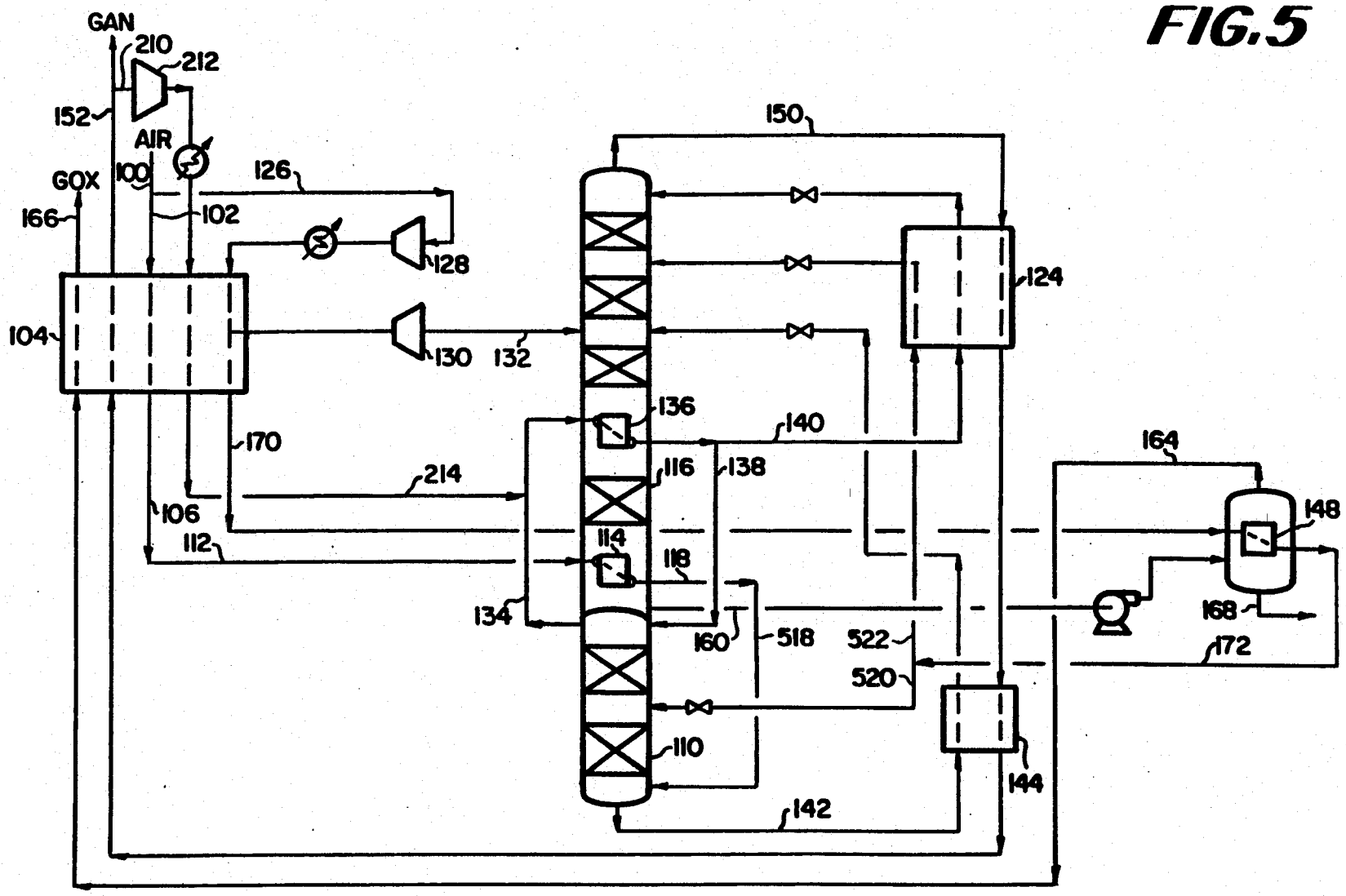

The embodiment shown in FIG. 5 is similar to the embodiment shown in FIG. 1 except for a few minor exceptions. In the embodiment of FIG. 5, all of the cooled feed air, major portion, line 106, is fed to and partially condensed in reboiler/condenser 114 located in the bottom of second distillation column 116 prior to being fed, via line 518, to the bottom of first distillation column 110. Further, the liquid air produced in boiler/condenser 148, line 172, is divided into two portions, lines 520 and 522. The first portion, line 520, is reduced in pressure and fed to the middle of first distillation column 110. The second portion, line 522, is reduced in pressure and fed to the upper middle of second distillation column 116.

The present invention has been described with reference to several specific embodiments thereof. These embodiments should not be viewed as a limitation of the present invention. The scope of the present invention should be ascertained from the following claims.

We claim:

1. In a process for the cryogenic distillation of air to separate out and produce at least one of its constituent components, wherein the cryogenic distillation is carried out in a distillation column system having at least two distillation columns operating at different pressures; a feed air stream is compressed to a pressure in the range between 70 and 300 psia and essentially freed of impurities which freeze out at cryogenic temperatures; at least a portion of the compressed, essentially impurities-free feed air is cooled and fed to and distilled in the first of the two distillation columns thereby producing a higher pressure nitrogen overhead and a crude liquid oxygen bottoms; the crude oxygen bottoms is reduced in pressure, and fed to and distilled in the second distillation column thereby producing a lower pressure nitrogen overhead and a liquid oxygen bottoms; a fraction of the cooled, compressed, essentially impurities-free feed air portion is at least partially condensed by heat exchange against the liquid oxygen bottoms in a first reboiler/condenser located in the bottom of the second distillation column and fed to at least one of the two distillation columns; at least a portion of the higher pressure nitrogen overhead is condensed by heat exchange against liquid descending the second distillation column in a second reboiler/condenser located in the low pressure column between the bottom of the second distillation column and the feed point of the crude liquid oxygen bottoms; the condensed higher pressure nitrogen is fed to at least one of the two distillation columns as reflux; and a gaseous nitrogen product is produced; the improvement to allow effective operation of the process at elevated pressures comprises:

(a) further compressing and cooling another portion of the compressed, essentially impurities free, feed air, thereby producing a further compressed second portion;

(b) removing and increasing the pressure of a portion of the liquid oxygen bottoms of the second column and heat exchanging the increased pressure liquid oxygen bottoms against at least a fraction of the further compressed second portion of step (a) so that upon heat exchange the fraction of the further compressed second portion of step (a) is condensed and the increased pressure liquid oxygen bottoms portion is at least partially vaporized;

(c) feeding the condensed fraction of step (b) to at least one of the two distillation columns;

(d) warming the at least partially vaporized oxygen of step (b) to recover refrigeration;

(e) compressing a portion of the gaseous nitrogen product and cooling it to a temperature near its condensation temperature by heat exchange against warming process streams; and (f) condensing the cooled, compressed gaseous nitrogen product portion of step (e) and feeding the condensed nitrogen portion as reflux to at least one of the distillation columns.

2. The process of claim 1 which further comprises work expanding a second fraction of the further compressed second portion of step (a) to the operating pressure of the second distillation column and feeding the expanded fraction to an intermediate location of the second distillation column.

3. The process of claim 2 wherein the work generated by the work expansion of the second fraction of the further compressed second portion of step (a) is used to further compress the another portion of the compressed, essentially impurities-free, feed air in step (a).

4. The process of claim 1 wherein the cooled, compressed gaseous nitrogen product portion condensed in step (f) is condensed in a reboiler/condenser located in an intermediate location of the second distillation column.

5. The process of claim 4 wherein an air stream is compressed in a compressor which is mechanically linked to a gas turbine and which further comprises compressing at least a portion of the gaseous nitrogen produced from the process for the cryogenic distillation of air; combusting the compressed, gaseous nitrogen, at least a portion of the compressed air stream and a fuel in a combustor thereby producing a combustion gas; work expanding the combustion gas in the gas turbine; and using at least a portion of the work generated to drive the compressor mechanically lined to the gas turbine.

6. The process of claim 1 wherein the cooled, compressed gaseous nitrogen product portion condensed in step (f) is condensed in a second passage of the reboiler/condenser located in the bottom location of the second distillation column and wherein the resulting condensed nitrogen is reduced in pressure of and fed to the top of the first distillation column as reflux.

7. The process of claim 6 wherein an air stream is compressed in a compressor which is mechanically linked to a gas turbine and which further comprises compressing at least a portion of the gaseous nitrogen produced from the process for the cryogenic distillation of air; combusting the compressed, gaseous nitrogen, at least a portion of the compressed air stream and a fuel in a combustor thereby producing a combustion gas; work expanding the combustion gas in the gas turbine; and using at least a portion of the work generated to drive the compressor mechanically linked to the gas turbine.

8. The process of claim 7 wherein at least a portion of the compressed feed air is derived from the air stream which has been compressed in the compressor which is mechanically linked to the gas turbine.

9. The process of claim 1 wherein the cooled, compressed gaseous nitrogen product portion condensed in step (f) is condensed in a reboiler/condenser located in the bottom of the first distillation column.

10. The process of claim 9 wherein an air stream is compressed in a compressor which is mechanically linked to a gas turbine and which further comprises compressing at least a portion of the gaseous nitrogen produced from the process for the cryogenic distillation of air; combusting the compressed, gaseous nitrogen, at least a portion of the compressed air stream and a fuel in a combustor thereby producing a combustion gas; work expanding the combustion gas in the gas turbine; and using at least a portion of the work generated to drive the compressor mechanically linked to the gas turbine.

11. The process of claim 10 wherein at least a portion of the compressed feed air is derived from the air stream which has been compressed in the compressor which is mechanically linked to the gas turbine.

12. The process of claim 1 wherein an air stream is compressed in a compressor which is mechanically linked to a gas turbine and which further comprises compressing at least a portion of the gaseous nitrogen produced from the process for the cryogenic distillation of air; combusting the compressed, gaseous nitrogen, at least a portion of the compressed air stream and a fuel in a combustor thereby producing a combustion gas; work expanding the combustion gas in the gas turbine; and using at least a portion of the work generated to drive the compressor mechanically linked to the gas turbine.

13. The process of claim 12 wherein at least a portion of the compressed feed air is derived from the air stream which has been compressed in the compressor which is mechanically linked to the gas turbine.

14. The process of claim 1 which further comprised work expanding the vaporized oxygen of step (d).

* * * * *